US009454970B2

(12) United States Patent
Sabin et al.

(10) Patent No.: US 9,454,970 B2
(45) Date of Patent: Sep. 27, 2016

(54) PROCESSING MULTICHANNEL AUDIO SIGNALS

(71) Applicant: Bose Corporation, Framingham, IL (US)

(72) Inventors: Andrew Sabin, Chicago, IL (US); Ricardo Garcia, Chicago, IL (US)

(73) Assignee: Bose Corporation, Framingham, MA (US)

( * ) Notice: Subject to any disclaimer, the term of this patent is extended or adjusted under 35 U.S.C. 154(b) by 252 days.

(21) Appl. No.: 14/323,756

(22) Filed: Jul. 3, 2014

(65) Prior Publication Data

US 2015/0012282 A1 Jan. 8, 2015

Related U.S. Application Data

(60) Provisional application No. 61/842,691, filed on Jul. 3, 2013.

(51) Int. Cl.
*G10L 19/00* (2013.01)
*G10L 21/00* (2013.01)
*G10L 19/008* (2013.01)

(52) U.S. Cl.
CPC ..... *G10L 19/008* (2013.01)

(58) Field of Classification Search
USPC ..... 704/501–504
See application file for complete search history.

(56) References Cited

U.S. PATENT DOCUMENTS 6,035,050 A 3/2000 Weinfurtner et al.
9,305,557 B2 * 4/2016 Nagel ..... G10L 19/0204
2003/0187663 A1 * 10/2003 Truman ..... G10L 21/038 704/500
2006/0009985 A1 * 1/2006 Ko ..... G11B 20/10 704/500
2008/0254753 A1 * 10/2008 Steenstra ..... H04R 5/04 455/90.1
2009/0154741 A1 6/2009 Woods et al.
2012/0095528 A1 4/2012 Miller et al.
2012/0183164 A1 7/2012 Foo et al.
2013/0051571 A1 * 2/2013 Nagel ..... G10L 19/0204 381/56
2013/0090933 A1 * 4/2013 Villemoes ..... G10L 19/0204 704/500
2013/0195276 A1 * 8/2013 Ojala ..... G10L 19/008 381/2

OTHER PUBLICATIONS

International Search Report and Written Opinion; PCT/US2015/021461; May 29, 2015; 10 pp.
'BlarneySaunders.com' [online] "IHear You® lets you take control of your hearing"; [retrieved Jun. 16, 2015]. Retrieved from the internet: URL<http://www.blameysaunders.com.au/ihearyou/ ; 3 pages.
'iTunes apple.com' [online]; "Starkey SoundPoint" by Starkey Laboratories, Inc. [retrieved Jun. 16, 2015]. Retrieved from the internet: URL<https://itunes.apple.com/us/app/starkey-soundpoint/id405249175?m1=8 ; 2pages.

(Continued)

*Primary Examiner* — Edgar Guerra-Erazo
(74) *Attorney, Agent, or Firm* — Fish & Richardson P.C.

(57) ABSTRACT

In order to enable audio applications for a mobile device that utilize more than one audio input, a peripheral audio device is provided for encoding multichannel audio signals into a reduced number of channels. The peripheral audio device receives audio signals from an audio input/output device, generates at least one output audio signal by combining the received audio signals, and transmits the at least one generated output audio signal to the mobile device. The number of received audio signals is greater than the number of generated output audio signals.

19 Claims, 6 Drawing Sheets

(56) References Cited

OTHER PUBLICATIONS

'iTunes apple.com' [online]; "Soundhawk" by Soundhawk [retrieved Jun. 16, 2015]. Retrieved from the internet: URL<https://itunes.apple.com/us/app/soundhawk/id914207113?mt=8 ; 2 pages.

'iTunes apple.com' [online]; "CS Customizer" by Sound World solutions [retrieved Jun. 16, 2015]. Retrieved from the internet: URL<https://itunes.apple.com/us/app/cs-customizer/id727309724?mt=8 ; 2 pages.

'iTunes apple.com' [online]; "Starkey $T^2$Remote" by Starkey Laboratories [retrieved Jun. 16, 2015]. Retrieved from the internet: URL<https://itunes.apple.com/us/app/starkey-t2-remote ; 2 pages.

* cited by examiner

PROCESSING MULTICHANNEL AUDIO SIGNALS

This application claims the benefit of Provisional Application Ser. No. 61/842,691, filed on Jul. 3, 2013, which is hereby incorporated by reference in its entirety.

FIELD

The present embodiments relate to the processing of multichannel audio signals.

BACKGROUND

Personal electronic devices such as, for example, smart phones, tablets, wearable computers, and personal computers (e.g., mobile devices) are widely used to record, process, and/or play audio signals. The number of discrete audio input channels of the mobile device may be less than desired by a user. For example, the mobile device may be a cellular phone, and the cellular phone may include, for example, a single 3.5 mm audio connector for all audio inputs and outputs. The 3.5 mm audio connector dedicates a single channel for audio input.

SUMMARY

In order to enable audio applications for a mobile device that utilize more than one audio input, a peripheral audio device is provided for encoding multichannel audio signals into a reduced number of channels. The peripheral audio device receives audio signals from an audio input/output device, generates at least one output audio signal by combining the received audio signals, and transmits the at least one generated output audio signal to the mobile device. The number of received audio signals is greater than the number of generated output audio signals.

In a first aspect, an apparatus for encoding multichannel audio signals into a reduced number of channels is provided. The apparatus includes inputs configured to receive audio inputs, respectively. The apparatus also includes a processor operatively connected to the inputs. The processor is configured to reduce bandwidth of the audio inputs, combine the reduced bandwidth audio inputs, such that the reduced bandwidth audio inputs do not overlap, and generate at least one audio output based on the combined reduced bandwidth audio inputs. The apparatus includes at least one output operatively connected to the processor. The at least one output is configured to transmit the at least one generated audio output. The number of audio inputs is greater than the number of generated audio outputs.

In a second aspect, a system for processing multichannel audio signals is provided. The system includes a peripheral for encoding the multichannel audio signals into a reduced number of channels. The peripheral includes first inputs configured to receive audio inputs, respectively. The peripheral also includes a first processor operatively connected to the first inputs. The first processor is configured to combine the received audio inputs and generate at least one audio output based on the combined received audio inputs. The peripheral includes at least one first output operatively connected to the processor. The at least one first output is configured to transmit the at least one generated audio output to a mobile device. The number of audio inputs is greater than the number of generated audio outputs. The system also includes the mobile device. The mobile device includes a second input configured to receive the at least one generated audio output from the peripheral. The mobile device also includes a second processor operatively connected to the second input. The second processor is configured to separate the audio inputs received by the peripheral from the at least one generated audio output received by the mobile device.

In a third aspect, a method for encoding multichannel audio signals and additional data into a reduced number of channels is provided. The method includes a processor receiving audio signals from an audio input/output device. The processor combines the received audio signals, such that at least one output audio signal is generated. The at least one generated output audio signal is transmitted to a mobile device that is separate from the processor. The number of received audio signals is greater than the number of generated output audio signals.

The present invention is defined by the following claims, and nothing in this section should be taken as a limitation on those claims. Further aspects and advantages of the embodiments are discussed below and may be later claimed independently or in combination.

DETAILED DESCRIPTION

Figure 1:
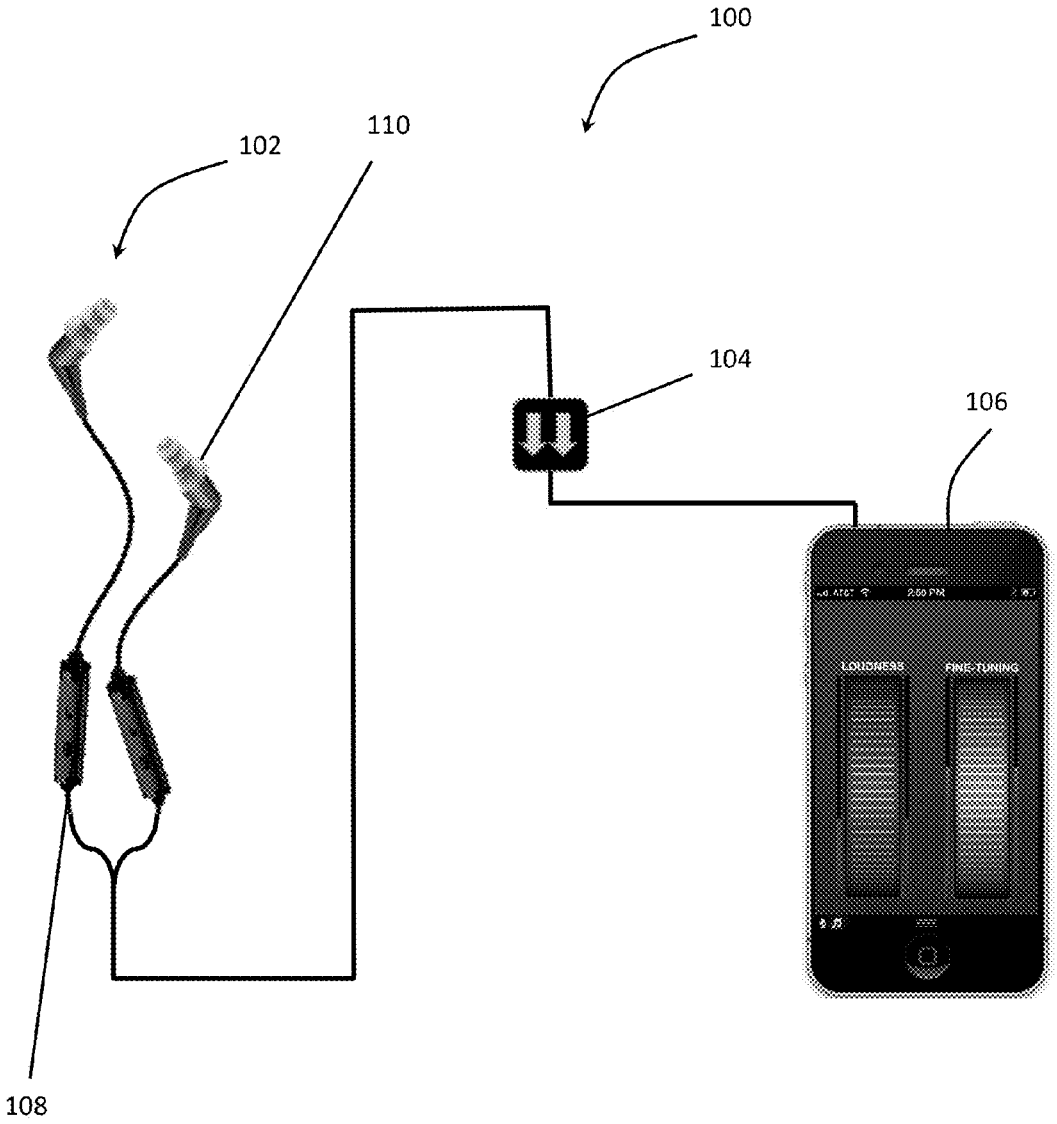
FIG. 1 shows one embodiment of a system for processing multichannel audio signals.

FIG. 1 shows one embodiment of a system 100 for processing multichannel audio signals. The system 100 includes an audio input/output device 102, an audio peripheral device 104, and a mobile device 106. The audio input/output device 102 is in communication with the audio peripheral device 104 via a wired connection or wirelessly. The audio peripheral device 104 is in communication with the mobile device 106 via a wired connection or wirelessly.

In one embodiment, the audio input/output device 102 includes two ear-level microphones/speakers. Each ear-level microphone/speaker includes a microphone 108 and a corresponding speaker 110 (e.g., one ear-level microphone/speaker 108, 110 for each ear of a user). In other embodiments, other audio input/output devices and/or more audio input/output devices may be provided (e.g., four microphones instead of two).

In one embodiment, each ear-level microphone/speaker 108, 110 is in communication with the audio peripheral device 104 via a wired connection. For example, each ear-level microphone/speaker 108, 110 is electrically connected to the audio peripheral device 104 via a separate wired connection. In other words, the audio peripheral device 104 includes at least two inputs, to which the two ear-level microphones/speakers 108, 110 are connected via wired connection, respectively (e.g., two 3.5 mm TRRS male connectors of the ear-level microphones/speakers 108, 110 connect to two corresponding 3.5 mm TRRS female connectors of the audio peripheral device 104 via wired connections). The audio peripheral device 104 may include more or fewer inputs. For example, the audio peripheral device 104 includes a single input connector (e.g., a single 3.5 mm TRRS female connector) with different segments for receiving different signals.

The audio peripheral device 104 is external and separate from the mobile device 106. The audio peripheral device 104 includes a housing storing components of the audio peripheral device 104. The housing of the audio peripheral device 104 may include an attachment device (e.g., a clip), such that the peripheral device 104 may be attached to a piece of clothing worn by the user. The audio peripheral device 104 is smaller than the mobile device 106 and may be sized such that the audio peripheral device 104 is attachable to the user or may be placed in a pocket of a piece of clothing worn by the user.

In one embodiment, the audio peripheral device 104 is in communication with the mobile device 106 via a single wired connection. For example, the audio peripheral device 104 includes a single output, to which the mobile device 106 is connected via wired connection (e.g., a 3.5 mm TRRS male or female connector of the audio peripheral device 104 connects to a 3.5 mm TRRS female connector of the mobile device 106 via a wired connection). The audio peripheral device 104 may include more outputs.

The mobile device 106 may be any number of computing devices such as, for example, a smart phone, a tablet, a wearable computer, a personal computer, or any other now known or later discovered computing devices. In one embodiment, the device 106 is a desktop computer.

The microphones 108 pick up sounds from a surrounding area and generate stereo audio signals. The stereo audio signals are transmitted to the audio peripheral device 104 via the wired connections, for example. The audio peripheral device 104 encodes the received stereo audio signals into a reduced number of channels. The encoded audio signals are transmitted to the mobile device 106, and the mobile device 106 decodes and further processes the encoded audio signals. The mobile device 106 transmits the processed audio signals to the speakers 110 via the audio peripheral device 104 for playback to the user, for example.

Figure 2:
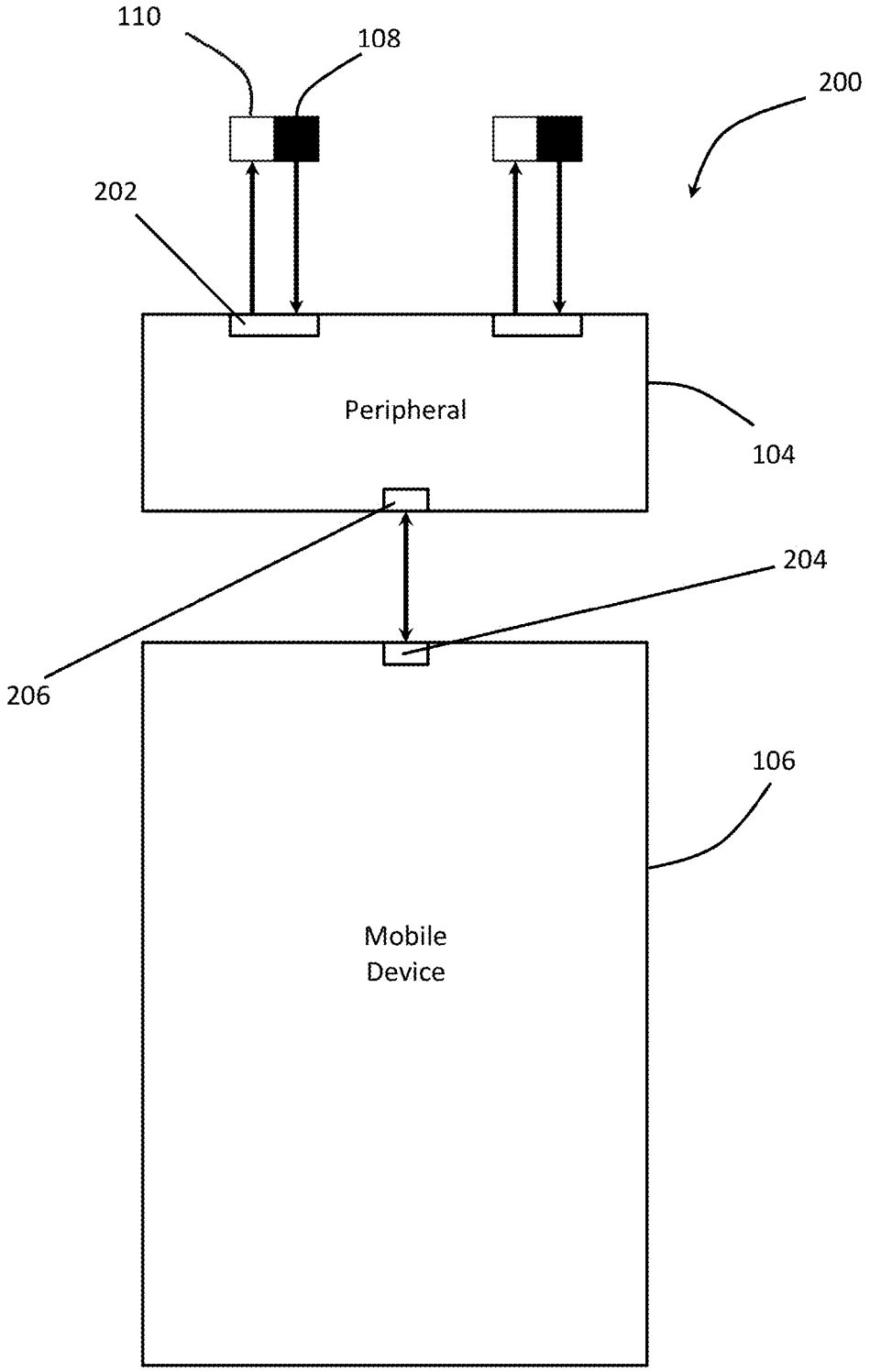
FIG. 2 shows another embodiment of a system for processing multichannel audio signals.

FIG. 2 shows one embodiment of a system 200 for processing multichannel audio signals. FIG. 2 shows the direction of data flow from the microphones 108 to the audio peripheral device 104, from the audio peripheral device 104 to the mobile device 106, and from the mobile device 106 back to the speakers 110, optionally via the audio peripheral device 104.

The audio peripheral device 104 receives N channels of audio input (e.g., N audio input signals) from a corresponding number of microphones 108, for example. The audio peripheral device 104 combines (e.g., multiplexes) the N audio input signals into M audio output signals, and transmits the M audio output signals to the mobile device 106. The number N of audio input signals is greater than the number M of audio output signals. In the embodiment shown in FIG. 2, the audio peripheral device 104 receives two audio input signals (e.g., N=2) via two corresponding inputs 202, combines the two received audio input signals into one audio output signal (e.g., M=1), and transmits the one audio output signal to an input/output 204 of the mobile device 106 (e.g., the only audio input/output of a smartphone) via an output 206 of the audio peripheral device 104.

The audio peripheral device 104 may combine the N audio input signals with any number of signal processing strategies. For example, the audio peripheral device 104 may combine the N audio input signals with signal processing strategies that limit and shift a frequency range of one or more of the N audio input signals.

In one embodiment, the audio peripheral device 104 filters the N audio input signals to reduce bandwidth of the N audio input signals so that each audio input signal takes up approximately 1/N of available frequency spectrum. After filtering, the audio peripheral device 104 shifts a frequency range of at least one of the N audio input signals via, for example, single-sideband modulation to minimize spectral overlap between the N channels of audio input.

In another embodiment, the audio peripheral device 104 applies frequency compression to reduce bandwidth of the N audio input signals so that each audio input signal takes up approximately 1/N of available frequency spectrum. After frequency compression, the audio peripheral device 104 shifts a frequency range of at least one of the N audio input signals via single-sideband modulation to minimize spectral overlap between the N channels of audio input.

The audio peripheral device 104 may also extract one or more acoustic features (e.g., K acoustic features; enriching information) from the N audio input signals. The one or more acoustic features may include, for example, statistics such as sound pressure level or sound level in upper frequency ranges. The audio peripheral device 104 transforms or encodes the one or more extracted acoustic features into an audio signal (e.g., an audio rate signal). For example, the audio peripheral device 104 transforms or encodes the one or more extracted acoustic features into the audio signal via frequency-shift keying modulation placed into an unoccupied portion of the spectrum. The audio peripheral device 104 combines the audio signal representing the extracted acoustic features with at least one of the M audio output signals.

The mobile device 106 receives the M audio output signals (e.g., one output signal) from the audio peripheral device 104. The mobile device 106 decodes (e.g., separates) the M channels of audio output into the original N channels of audio input from the audio input/output device 102. For example, if one of the N channels of audio input was shifted upward in frequency by the audio peripheral device 104, the mobile device 106 shifts the one channel of audio input back down to the original frequency. The decoded signals may be recorded, further processed (e.g., transformed), and/or output from the mobile device 106.

In one exemplary embodiment, a first audio input signal of the N audio input signals corresponds to an audio signal generated by a microphone 108 in, on, or near the left ear of the user, and a second audio input signal of the N audio input signals corresponds to an audio signal generated by a microphone 108 in, on, or near the right ear of the user. The audio peripheral device 104 applies a low-pass filter at a cutoff frequency to both the first audio input signal and the second audio input signal. The frequency cutoff of the low-pass filter may be selected based on a frequency above which the user cannot hear. The frequency cutoff may be any number of frequencies including, for example, 9.5 kHz for some individuals with impaired hearing. Other frequency cutoffs may be selected. The audio peripheral device 104 shifts one of the audio input signals (e.g., the second audio input signal) up in frequency. The audio peripheral device 104 may shift the second audio input signal up in frequency such that the second audio input signal does not overlap with the first audio input signal when the first audio input signal is combined with the shifted second audio input signal. In one embodiment, the audio peripheral device 104 shifts the second audio input signal up by 10 kHz using, for example, single sideband amplitude modulation. At this point, the first audio input signal spans 0-9.5 kHz, and the second audio input signal spans 10-19.5 kHz.

In the exemplary embodiment, the audio peripheral device 104 computes an actual sound pressure level (e.g., a calibrated sound pressure level) for each audio input signal of the first audio input signal and the second audio input signal. The audio peripheral device 104 translates the computed actual sound pressure levels into a frequency shift key modulated signal that spans a frequency range. The frequency range of the frequency shift key modulated signal may be any number of frequency ranges including, for example, 20-22.05 kHz. The audio peripheral device 104 combines the first audio input signal, the shifted second audio input signal, and the frequency shift key modulated signal.

In the exemplary embodiment, the combined signal is transmitted from the audio peripheral device 104 to the mobile device 106 via a wired connection between a 3.5 mm TRRS connector (e.g., a 3.5 mm TRRS female connector) of the audio peripheral device 104 and a 3.5 mm TRRS connector (e.g., a 3.5 mm TRRS female connector) of the mobile device 106.

The mobile device 106 filters (e.g., separates) the combined signal into, for example, three frequency ranges (e.g., corresponding to the first audio input signal, the second audio input signal, and the frequency shift key modulated signal, respectively). For example, the three frequency ranges are 0-9.5 kHz, 10-19.5 kHz, and 20-22.05 kHz. The mobile device 106 shifts the middle frequency range (e.g., 10-19.5 kHz) downward via, for example, single-sideband modulation to return the middle frequency range of the combined signal to the original frequency range (e.g., 0-9.5 kHz, corresponding to the second audio input signal). The first audio input signal and the second audio input signal are independent and available for processing at the mobile device 106. The mobile device 106 also decodes the computed actual sound pressure levels from the highest frequency range of the combined signal (e.g., the frequency shift key modulated signal). The mobile unit 106 may process the first audio input signal and the second audio input signal according to parameters related to hearing loss of the user of the mobile device 106 and the computed actual sound pressure levels. The processed first audio input signal and the processed second audio input signal are transmitted from the mobile device 106 to the audio peripheral device 104 via two segments of the 3.5 mm TRRS connector of the mobile device 106. The audio peripheral device 104 transmits the processed first audio input signal and the processed second audio input signal to speakers 110 in, on, or near the left ear and the right ear of the user, respectively. All of the processing occurs in real-time, and the system functions like a stereo hearing aid.

Figure 3:
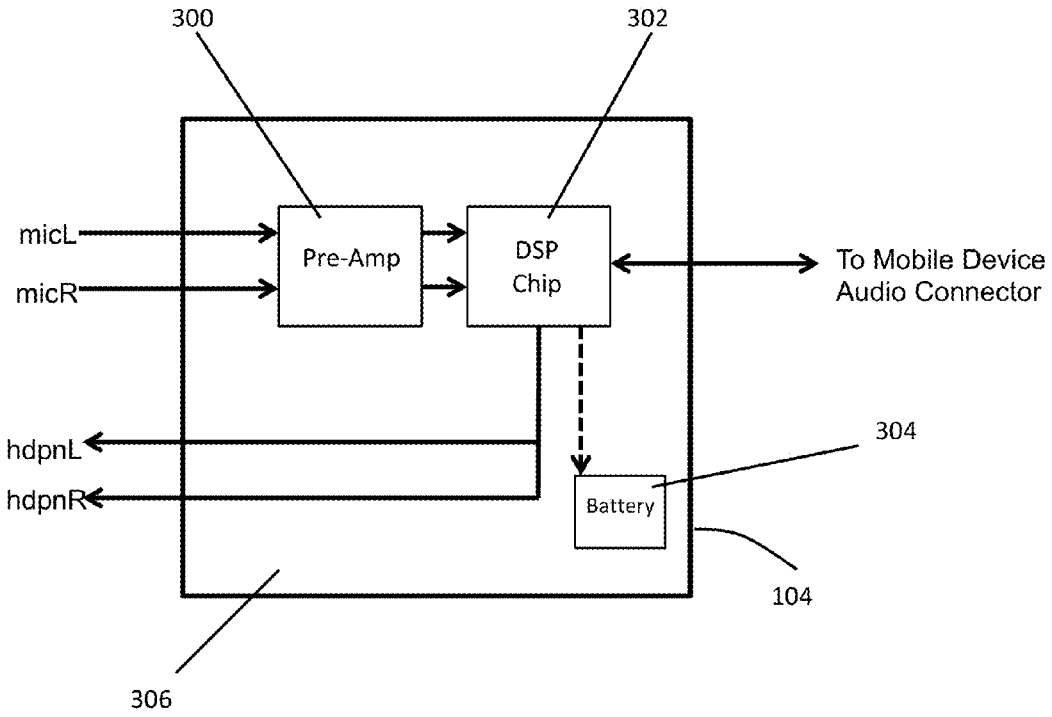
FIG. 3 shows one embodiment of a peripheral audio device.

FIG. 3 shows one embodiment of the peripheral audio device 104 configured to perform at least some of the acts described above and below. The peripheral audio device 104 includes a pre-amplifier 300, a processor 302, and a battery 304. The pre-amplifier 300 and the processor 302 are in communication with each other and are disposed in a housing 306. The battery 304 is also disposed in the housing 306 and provides power for the processor 302 and/or other components of the peripheral audio device 104. The peripheral audio device 104 may include more or fewer components. For example, the peripheral audio device 104 may also include a memory.

The pre-amplifier amplifies audio signals (e.g., stereo audio signals labeled micL and micR in FIG. 3) received at the inputs of the peripheral audio device 104 (e.g., from the microphones 108). After amplification, the audio signals are transmitted to the processor 302, which performs at least some of the acts described above and below. The processor 302 may be any number of processors including, for example, a microprocessor, a digital signal processor (DSP) chip, an application specific integrated circuit (ASIC), or any other now known or future discovered processors. The processor 302 transmits encoded audio signals to the mobile device 106, for example, via one or more inputs/outputs of the peripheral audio device 104. The processor 302 receives decoded audio signals from the mobile device 106 via the one or more inputs/outputs of the peripheral audio device 104. The processor 302 outputs the decoded audio signals (e.g., labeled hdpnL and hdpnR) received from the mobile device 106 via the inputs of the peripheral audio device 104, which receive stereo audio signals micL and micR, or via other outputs of the peripheral audio device 104. The mobile device 106 includes a processor, a memory, a display, and/or other components. The mobile device 106 may include more or fewer components. The processor may be any number of processors including, for example, a microprocessor, a digital signal processor (DSP) chip, an application specific integrated circuit (ASIC), or any other now known or future discovered processors. The processor of the mobile device 106 may perform at least some of the acts described above and below.

The embodiments described above may be applied in a number of different ways. For example, the mobile device 106 may generate and transmit audio-rate signals (e.g., control signals) to the audio peripheral device 104. The control signals may, for example, be frequency-shift keying-modulated signals. The control signals transmitted to the audio peripheral device 104 may change how the N channels of audio input are processed. For example, the control signals may direct the audio peripheral device 104 as to how bandwidth reduction of the N audio input signals is accomplished (e.g., via filtering or frequency compression). As other examples, the control signals may identify which acoustic features the audio peripheral device 104 is to extract and/or may identify whether configuration of an output connector of the peripheral device 104 matches the mobile device 106 in use.

In another embodiment, the audio peripheral device 104 includes a calibrated set of microphones that are separate from the microphones 108 and are housed within the audio peripheral device 104. A level and frequency spectrum of the microphones 108 may be calibrated by placing the calibrated microphones of the audio peripheral device 104 next to the microphones 108 and comparing a difference in level and spectrum. A processor of the peripheral device 104 or the mobile device 106 may compare the difference in level and spectrum.

In yet another embodiment, the mobile device 106 transmits the decoded signals to the audio peripheral device 104, and the audio peripheral device 104 measures output current. Sensitivity of the speakers 110 may be communicated to the audio peripheral device 104. The audio peripheral device 104 and/or the mobile device 106 may calculate sound pressure level delivered by the speakers based on the measured output current and the sensitivity of the speakers 110.

In an embodiment, more than one microphone may be connected to the audio peripheral device 104 to make an audio or video recording. The audio peripheral device 104 encodes the audio signals generated by the more than one microphone and transmits the encoded audio signals to the mobile device 106. The mobile device 106 decodes the encoded audio signals and records the decoded audio signals at the mobile device 106.

In one embodiment, an array of microphones 108 may be connected to the audio peripheral device 104. The mobile device 106 may intelligently combine audio signals generated by the array of microphones 108 to dynamically change directionality of the plurality of microphones 108.

In another embodiment, a user may view illustrations about a sound field in an acoustic environment that surrounds the user. The mobile device 106 may combine the N input audio signals to display statistics about the acoustic environment at the mobile device 106. The displayed statistics may include, for example, spatial position, frequency, and sound level.

In yet another embodiment, decoded signals at the mobile device 106 may be used to facilitate speech in noise. The decoded signals may also be used to identify potentially dangerous or attractive signals based in part on spatial location, and the mobile device 106 may make the identified signals more audible. Artificial sounds may also be used to facilitate an enhanced environment.

Figure 4:
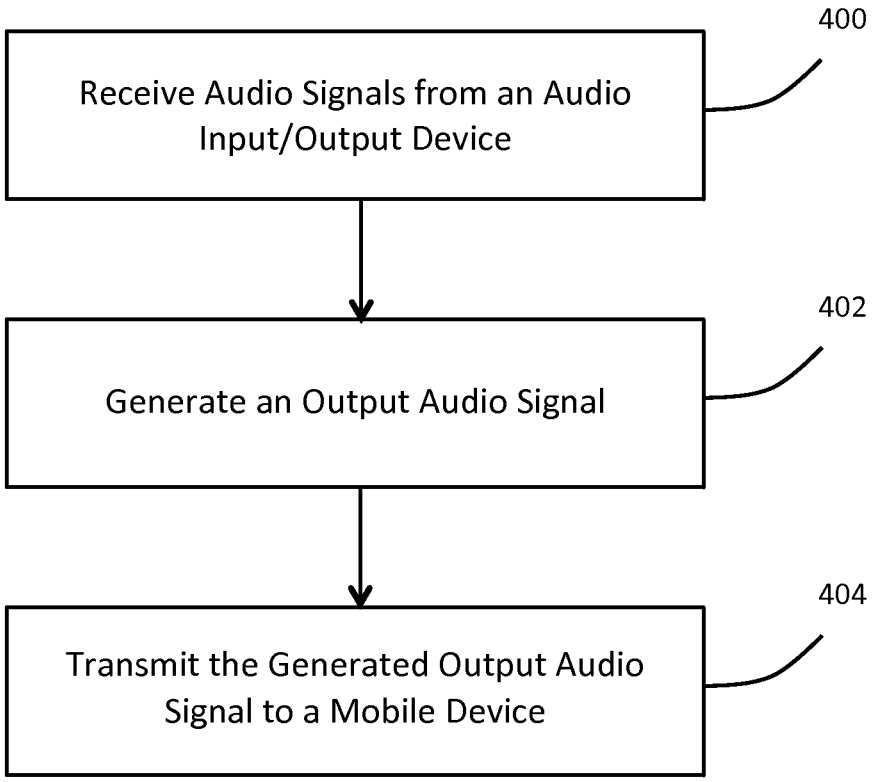
FIG. 4 shows a flowchart of one embodiment of a method for encoding multichannel audio signals into a reduced number of channels.

FIG. 4 shows a flowchart of one embodiment of a method for encoding multichannel audio signals into a reduced number of channels. The method may be performed using the system 100 shown in FIG. 1, the system 200 shown in FIG. 2, and/or the peripheral audio device 104 of FIG. 3 (e.g., at least some of the acts of the method may be performed by the processor 302), or another system or device. The method is implemented in the order shown, but other orders may be used. Additional, different, or fewer acts may be provided. Similar methods may be used for encoding multichannel audio signals into a reduced number of channels.

In act 400, a processor of an audio peripheral device receives audio signals from an audio input/output device. The audio input/output device may include a microphone/speaker at the left ear of a user, and a microphone/speaker at the right ear of the user. The audio peripheral device is external and separate from a mobile device, with which the audio peripheral device is in communication. The processor of the audio peripheral device may receive the audio signals from the audio input/output device via a wireless or a wired connection.

Figure 5:
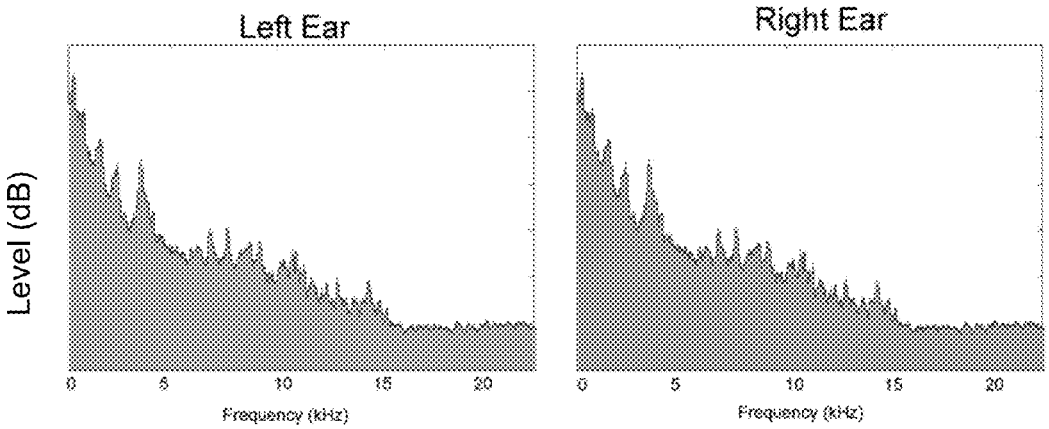
FIGS. 5-8 show exemplary plots of audio signals corresponding to the method of FIG. 4.

FIG. 5 shows exemplary plots of the audio signals received by the audio peripheral device, from the microphone at the left ear of the user and the microphone at the right ear of the user (e.g., level (dB) versus frequency (kHz)), respectively. A user with hearing loss may not be able to hear sound above a frequency threshold (e.g., 10 kHz).

In act 402, the processor of the audio peripheral device generates at least one output audio signal. The processor may combine the received audio signals in any number of ways to generate the at least one output audio signal. The processor may combine the received audio signals by reducing a bandwidth of each of the received audio signals, shifting a frequency range of at least one of the reduced bandwidth audio signals from a respective original frequency range to a respective shifted frequency range, and combining the at least one reduced bandwidth audio signal having the shifted frequency range with the other reduced bandwidth audio signals. The bandwidth of each of the received audio signals may be reduced by filtering each of the received audio signals or by applying frequency compression to each of the received audio signals.

Figure 6:
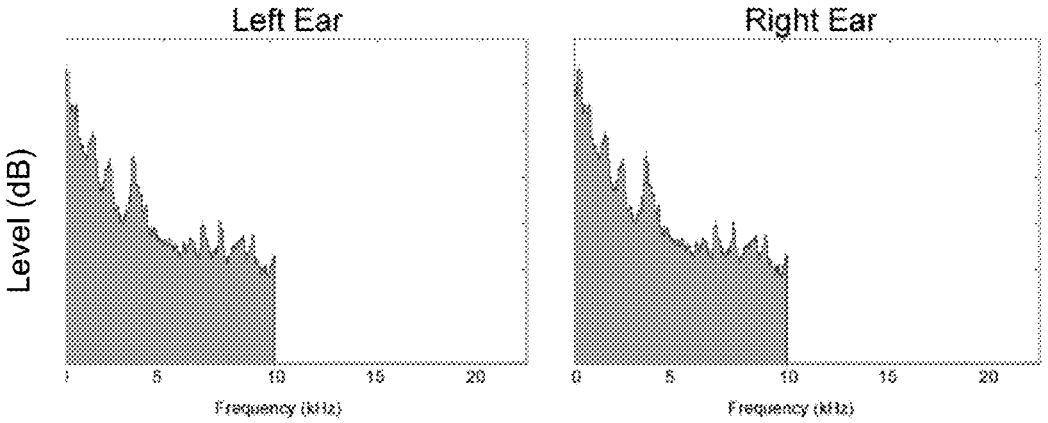

FIG. 6 shows exemplary plots of the audio signals received from the microphones after the audio peripheral device has applied bandwidth reduction. The bandwidth reduction (e.g., via filtering or frequency compression) may reduce the bandwidth such that the received audio signals only take up a portion of the frequency spectrum. The portion of the frequency spectrum may be the portion of the frequency spectrum the user can hear. For example, the audio peripheral device applies a low-pass filter at 10 kHz, as shown in FIG. 6, to each of the received audio signals.

Figure 7:
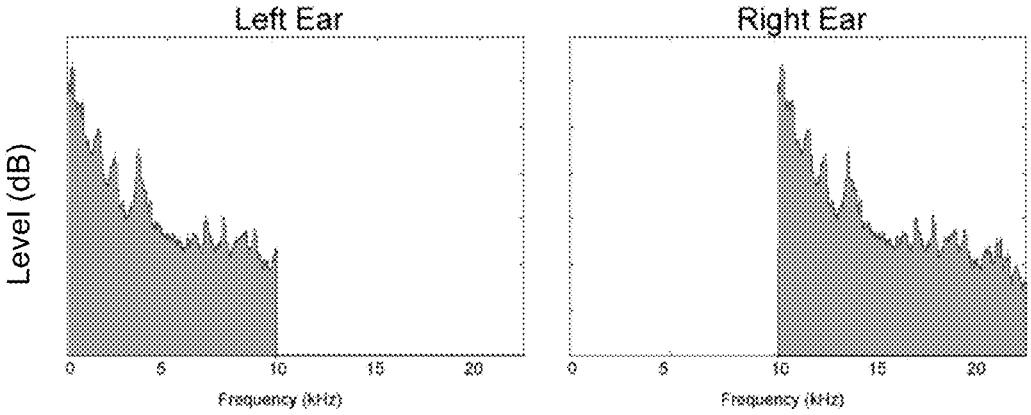

FIG. 7 shows exemplary plots of the received audio signals after the audio peripheral device has applied bandwidth reduction and has shifted the frequency range for one of the received audio signals. For example, as shown in FIG. 7, the audio peripheral device may shift the frequency range for the audio signal received by the audio peripheral device, from the microphone at the right ear of the user. The audio peripheral device may shift the frequency range for the audio signal received from the microphone at the right ear of the user by 10 kHz. The audio peripheral device may shift the frequency range for one or more of the received audio signals by any number of frequencies. For example, the audio peripheral device may receive three audio signals, and the audio peripheral device may shift, after bandwidth reduction, a second of the three audio signals by 10 kHz, and a third of the three audio signals by 20 kHz. More audio signals may be received by the audio peripheral device, and more than one or two bandwidth reduced audio signals may be shifted by the audio peripheral device.

Figure 8:
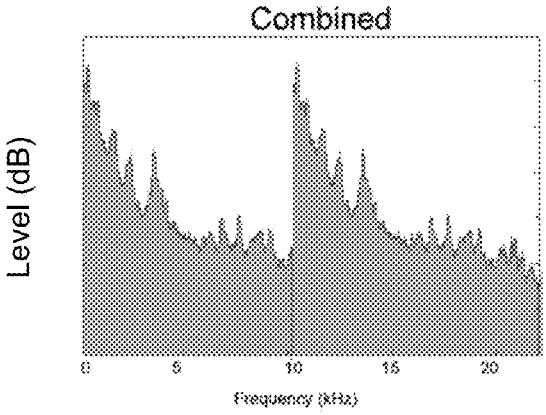

FIG. 8 shows an exemplary plot of the reduced bandwidth audio signal having the shifted frequency range (e.g., the audio signal received from the microphone at the right ear) combined with the other reduced bandwidth audio signal (e.g., the audio signal received from the microphone at the left ear).

In one embodiment, the processor of the audio peripheral device calculates a sound pressure level or one or more other acoustic features for each of the received audio signals. The processor of the audio peripheral device translates each of the calculated sound pressure levels, for example, into a frequency shift key modulated signal. The generation of the at least one output audio signal includes combining the received audio signals (e.g., after reducing bandwidth and frequency shifting, as discussed above) and the frequency shift key modulated signal. In one embodiment, the combined signal, as shown in FIG. 8, also includes the frequency shift key modulated signal (e.g., between 20 kHz and 22.5 kHz).

In act 404, the at least one generated output audio signal is transmitted to the mobile device. The processor of the audio peripheral device may transmit the at least one generated output audio signal from the audio peripheral device via a wireless or a wired connection. The number of generated output audio signals is less than the number of audio signals received from the audio input/output device. For example, the audio peripheral device receives two audio input signals from the audio input/output device via corresponding inputs of the audio peripheral device, and outputs one generated output audio signal via one output of the audio peripheral device.

In one embodiment, a processor of the mobile device receives the at least one generated output audio signal output by the audio peripheral device. The processor of the mobile device separates (e.g., decodes) signals (e.g., signals corresponding to the audio signals received by the audio peripheral device) from the at least one generated output audio signal. In one embodiment, the separating of the signals from the at least one generated output audio signal includes filtering the at least one generated output signal into at least two frequency ranges. The separating of the signals also includes shifting at least one frequency range of the at least two frequency ranges from the respective shifted frequency range to the respective original frequency range. The processor of the mobile device may further process the separated signals.

The processor of the mobile device may decode the sound pressure levels from the at least one generated output audio signal. The further processing of the separated signals may include processing the separated signals based on a parameter related to hearing loss for a user of the mobile device and based on the sound pressure levels decoded from the at least one generated output audio signal.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An apparatus for encoding multichannel audio signals into a reduced number of channels, the apparatus comprising:

inputs configured to receive audio inputs, respectively;

a processor operatively connected to the inputs and configured to:

reduce bandwidth of the audio inputs, combine the reduced bandwidth audio inputs, such that the reduced bandwidth audio inputs do not overlap, and generate at least one audio output based on the combined reduced bandwidth audio inputs; and at least one output operatively connected to the processor and configured to transmit the at least one generated audio output, wherein the number of audio inputs is greater than the number of generated audio outputs.

2. The apparatus of claim 1, wherein the number of audio inputs is two, and the number of audio outputs is one.

3. The apparatus of claim 1, wherein the inputs are configured to receive the audio inputs wirelessly, and the at least one output is configured to transmit the at least one generated audio output wirelessly.

4. The apparatus of claim 1, wherein the generation of the at least one audio output comprises the processor being further configured to apply a filter to each of the audio inputs to reduce bandwidth of the audio inputs, respectively, and shift a frequency range of at least one of the filtered audio inputs, and being further configured to combine the at least one filtered audio input having the shifted frequency range with the other filtered audio inputs, the at least one generated audio output being based on the combination of the at least one filtered audio input having the shifted frequency range and the other filtered audio inputs, or wherein the generation of the at least one audio output comprises the processor being further configured to apply frequency compression to each of the audio inputs to reduce bandwidth of the audio inputs, respectively, and shift a frequency range of at least one of the frequency compressed audio inputs, and being further configured to combine the at least one frequency compressed audio input having the shifted frequency range with the other frequency compressed audio inputs, the at least one generated audio output being based on the combination of the at least one frequency compressed audio input having the shifted frequency range with the other frequency compressed audio inputs.

5. The apparatus of claim 1, wherein the processor is further configured to:

extract data from the audio inputs, the extracted data representing acoustic features relating to the audio inputs;

transform the extracted data into an audio signal; and combine the transformed extracted data with the at least one generated audio output.

6. A system for processing multichannel audio signals, the system comprising:

a peripheral for encoding the multichannel audio signals into a reduced number of channels, the peripheral comprising:

first inputs configured to receive audio inputs, respectively;

a first processor operatively connected to the first inputs and configured to:

combine the received audio inputs, and generate at least one audio output based on the combined received audio inputs;

at least one first output operatively connected to the processor and configured to transmit the at least one generated audio output to a mobile device, wherein the number of audio inputs is greater than the number of generated audio outputs; and the mobile device comprising:

a second input configured to receive the at least one generated audio output from the peripheral, and a second processor operatively connected to the second input and configured to separate the audio inputs received by the peripheral from the at least one generated audio output received by the mobile device.

7. The system of claim 6, wherein the at least one first output is connected to the second input via a wired connection or a wireless connection.

8. The system of claim 6, wherein the at least one first output is connected to the second input via a wired connection, and wherein the second input is a 3.5 mm audio connector.

9. The system of claim 6, further comprising an audio input/output device in communication with the first inputs of the peripheral via a wired connection or a wireless connection, wherein the audio input/output device is configured to generate the audio inputs and transmit the audio inputs to the peripheral via the wired connection or the wireless connection.

10. The system of claim 9, wherein the audio input/output device comprises two ear-level microphones/speakers.

11. The system of claim 9, wherein the second processor is further configured to process the separated audio inputs according to parameters relating to hearing loss of a user of the mobile device.

12. The system of claim 11, wherein the second input is an input/output, the input/output being configured to output the processed audio inputs to the audio input/output device.

13. The system of claim 6, wherein the first processor is further configured to:

reduce a bandwidth of each of the received audio inputs; and shift a frequency range of at least one of the reduced bandwidth audio inputs from a respective original frequency range to a respective shifted frequency range, wherein the combination of the received audio inputs comprises the first processor being further configured to combine the at least one reduced bandwidth audio input having the shifted frequency range with the other reduced bandwidth audio input.

14. A method for encoding multichannel audio signals and additional data into a reduced number of channels, the method comprising:

receiving, by a first processor, audio signals from an audio input/output device;

generating, by the first processor, at least one output audio signal, the generating comprising combining the received audio signals;

transmitting the at least one generated output audio signal to a mobile device comprising a second processor that is separate from the first processor, wherein the number of received audio signals is greater than the number of generated output audio signals;

receiving, by the second processor, the at least one generated output audio signal;

separating, by the second processor, the audio signals received by the first processor from the at least one generated output audio signal; and processing the separated audio signals.

15. The method of claim 14, further comprising:

calculating, by the first processor, an acoustic feature for each of the received audio signals; and translating each of the acoustic features into a frequency shift key modulated signal, wherein the generating comprises combining the received audio signals and the frequency shift key modulated signal.

16. The method of claim 15, further comprising decoding the acoustic features from the at least one generated output audio signal, wherein the processing comprises processing based on a parameter related to hearing loss for a user of the mobile device and based on the acoustic features.

17. The method of claim 14, wherein the combining comprises:

reducing a bandwidth of each of the received audio signals;

shifting a frequency range of at least one of the reduced bandwidth audio signals from a respective original frequency range to a respective shifted frequency range; and combining the at least one reduced bandwidth audio signal having the shifted frequency range with the other reduced bandwidth audio signals.

18. The method of claim 17, wherein the reducing comprises filtering each of the received audio signals or applying frequency compression to each of the received audio signals.

19. The method of claim 18, wherein the separating comprises:

filtering the at least one generated output signal into at least two frequency ranges; and shifting a frequency range of the at least two frequency ranges from the respective shifted frequency range to the respective original frequency range.

* * * * *